United States Patent [19]

Schwendemann

[11] Patent Number: 4,494,609

[45] Date of Patent: Jan. 22, 1985

[54] TEST TREE

[75] Inventor: Kenneth L. Schwendemann, Lewisville, Tex.

[73] Assignee: Otis Engineering Corporation, Dallas, Tex.

[21] Appl. No.: 329,920

[22] Filed: Dec. 11, 1981

Related U.S. Application Data

[63] Continuation-in-part of Ser. No. 258,689, Apr. 29, 1981, abandoned.

[51] Int. Cl.[3] ..... E21B 7/12

[52] U.S. Cl. ..... 166/336; 166/363; 166/322

[58] Field of Search ..... 166/363, 364, 344, 336, 166/322, 321, 337

[56] References Cited

U.S. PATENT DOCUMENTS

| | | | |
|---|---|---|---|
| 3,411,576 | 11/1968 | Taylor | 166/344 |
| 3,509,913 | 5/1970 | Lewis | 166/321 |
| 3,870,101 | 3/1975 | Helmus | 166/322 |
| 4,116,272 | 9/1978 | Barrington | 166/363 |
| 4,215,355 | 7/1980 | Rearder | 166/336 |
| 4,234,043 | 11/1980 | Roberts | 166/336 |
| 4,253,525 | 3/1981 | Young | 166/336 |
| 4,733,531 | 6/1982 | Lawson | 166/344 |

*Primary Examiner*—William F. Pate, III

*Attorney, Agent, or Firm*—Vinson & Elkins

[57] ABSTRACT

A subsurface test tree so compact in its vertical dimension that the entire tree can be positioned below the blind rams in a blowout preventer stack. When the stinger is removed the remaining valve section of the tree will be below the blind rams in any conventional blowout preventer stack.

The valve operators are split, one carried by the stinger and one carried in the valve housing with the arrangement of operator and valve in the housing providing an extremely small vertical dimension. A dome charge is effective on a piston to drive a ball valve to closed position to cut a line extending through the ball valve and to provide sequential operation between the ball valve on bottom and the valve thereabove which may be a flapper valve so that the lower valve closes and the line is cut before the upper valve closes.

In one form the invention includes a subsurface safety valve below the test tree operated by one of control or balance pressure fluid.

36 Claims, 13 Drawing Figures

114
112
75
111
71
74
78
73
69b
72
69a
76
76b
23
34
111a
86
87
113
103
102
88
66
68
67
81
85
89
91
92
95
98
97
82
67a
83
76a
88
84
106
94
112
109
107
108
93

65
116
115
64
101
75
66
77
103
104
102
69
86
85
89
71
66a
74
87
68
91
67
78
92
81
73
87
69b
72
82
98
67a
69a
83
76
76a
76b
99
97
84
101
94
110
105
96
109
107
108
93

TEST TREE

This application is a continuation-in-part of my copending application Ser. No. 06/258,689 filed April 29, 1981 abandoned.

This invention relates to test trees and systems for testing and producing offshore wells.

In the production testing of offshore wells it is desirable to be able to quickly disconnect the production test string from the well in the event of an emergency such as adverse weather conditions. In making the quick disconnect provision must be made for shutting in the well.

Suitable apparatus for this process was shown in Taylor U.S. Pat. No. 3,411,576, issued Nov. 19, 1968. In the Taylor patent multiple valves with multiple valve operators were left in the well and the production string above the blowout preventer stack was released from the test tree leaving it in the blowout preventer stack when a disconnect was indicated, as by adverse weather conditions. Taylor taught that the tree was suspended in the wellhead and the blowout preventers control flow about the exterior of the tree and valves in the tree control flow through the tree.

Later versions of test trees are shown in the patents to Aumann, U.S. Pat. No. 3,955,623 issued May 11, 1976; Young, U.S. Pat. No. 3,967,647 issued July 6, 1976; and Helmus, U.S. Pat. No. 3,870,101 issued Mar. 11, 1975. In the Aumann device dual flapper valves are provided and the operator for opening the flapper valves is carried in a stinger which is disconnected leaving the two flapper valves in the well. In the Young patent the combination of a ball valve and a flapper valve which are left in the well is disclosed in which dual valve operators are provided in the stinger which are removed when the stinger is retrieved leaving dual valves in the well.

In the commercial form of the tree utilized by the Assignee of the Aumann and Young patents, the valve housing after the stinger has been removed can be below the blanking rams of a blowout preventer stack.

The Helmus patent shows another form of test tree in which dual valves and their operators are left in a well after the stinger is removed.

In the publication OEC 5229 of Otis Engineering Corporation, Dallas, Tex., a tree is shown having dual ball valves which are left in the well after the stinger is removed. The stinger carries the operator for both ball valves. As in the Young patent, it is contemplated in the Otis publication that the lower ball will act as a cutter to cut a wireline which may be extended through the tree when it is decided to quickly disconnect. In the publication a shear pin arrangement provides for a delayed closing of the upper ball valve to permit the lower ball valve to cut a line and the line to be retracted through the upper ball valve prior to closing of the upper valve. The tree of the publication again provides a system in which the tree body portion which carries the valves may be positioned below blind rams of a blowout preventer after the stinger has been disconnected. None of the above test trees teach a tree which is so short in vertical dimension that the entire tree may be positioned below the blind rams of a blowout preventer which in an emergency can cut through the production tubing, flowlines, etc., above the tree to shut in the well below the blind rams. Further, in the event of cutting through the production tubing above the tree and severing all control lines, the system should fail safe; that is, the control valves should automatically close to shut-in flow from the formation.

Where the prior art utilized a ball valve one spring was used to oppose control pressure and a second spring used to hold the ball in closed position.

In some instances it is desirable to flow the well for a sufficient length of time through the test tree that the well may be considered on production. In such instances it is sometimes desirable to have a subsurface safety valve which is controlled from the surface and which will shut in the well in accordance with known procedures in the event of some unusual occurrence happening at the surface, such as an accident which might result in escape of well fluids into the environment.

In the past a subsurface safety valve has been included in the tubing below a test tree by utilizing the chemical injection line which passed through the tree as a conduit to supply hydraulic fluid to the subsurface safety valve to control its operation. This system, while providing for control of the subsurface safety valve, eliminated the possibility of use of the flowway through the tree to inject chemicals into the well.

A pierced slick joint, such as disclosed in this application, has also been utilized in the past as a means of conveying fluid past a blowout preventer stack, but not for the purpose of controlling a subsurface safety valve.

It is an object of this invention to provide an extremely short subsurface test tree in which the entire tree may be positioned below the blind ram of a conventional blowout preventer stack.

Another object is to provide an extremely short test tree in which when the control stinger is unlatched from the valve housing and lifted, the valve housing will be below the blind rams in all conventional offshore blowout preventer stacks.

Another object is to provide a test tree having multiple valves in which the forces urging the lower valve toward closed position are greater than those urging the upper valve toward closed position so that the lower valve may sever a line therein and the line be removed from the upper valve prior to closing of the upper valve.

Another object is to provide a test tree in which provisions are made for balancing the operator pistons of all valves so that the tree may be used at any depth and wherein any failure of a dynamic seal will result in flow into the balance system and result in the valve failing safe.

Another object is to provide for closing of a valve in a test tree under the influence of a dome charge as well as a normal closure spring to provide ample force for cutting a line extending through the valve.

Another object is to provide a test tree as in the preceding object with a balance line so that if the dome charge is lost the balance line may be pressurized to provide force for cutting through a line.

Another object is to provide a subsurface test tree in which the lower valve may cut through a line and in which the force applied to the valve member to rotate it to closed position is provided by a force applying means which is a permanent part of the valve housing portion of the tree so that maximum power may be applied to the lower valve to cut through a line.

Another object is to provide a single spring for the lower ball valve of a test tree which both opposes control pressure and moves the ball to closed position.

It is an object of this invention to provide a test tree in combination with a surface controlled subsurface safety valve in which the safety valve may be controlled with pressure fluid normally present in one of the pressure fluid flowways in the safety valve without losing the function normally serviced by such flowway.

Another object is to provide with a subsurface test tree a surface control subsurface safety valve in the tubing below the tree in which the subsurface safety valve is controlled by the pressure fluid which acts as the control fluid for the tree or by the pressure fluid which acts as a balance fluid for the tree.

Another object is to provide a test tree and surface control subsurface safety valve, as in the above objects, in combination with a pierced slick joint in fluid communication with a fluted hanger for supporting the test tree in a wellhead with the control line to the subsurface valve extending between the valve and the fluted hanger.

Other objects, features and advantages of the invention will be apparent from the drawings, the specification and the claims.

In the drawings wherein an illustrated form of this invention is shown and wherein like numerals indicate like parts;

Figures 3A, 4A:
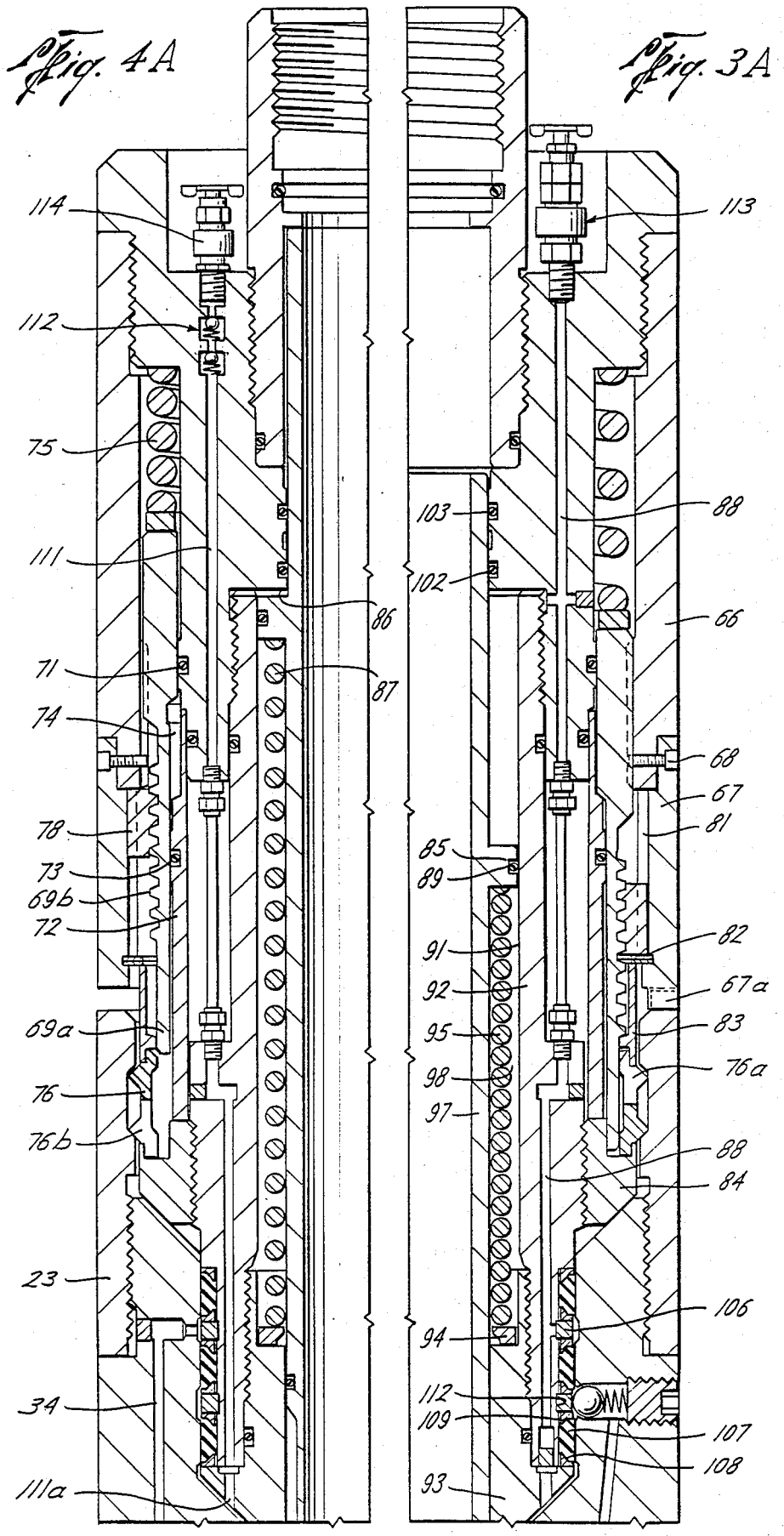
FIGS. 3A and 3B are quarter-section continuation views taken along the line 3—3 of FIG. 7 showing the control valves in open position.
FIGS. 4A and 4B are quarter-section continuation views similar to FIGS. 3A and 3B taken along the line 4—4 of FIG. 7 showing the opposite quadrant of the valve with the valves in closed position, FIGS. 3A, 4A, 3B and 4B when considered together providing a full sectional view through the subsurface test tree and showing the valves in open and closed position.
Figures 3B, 4B:
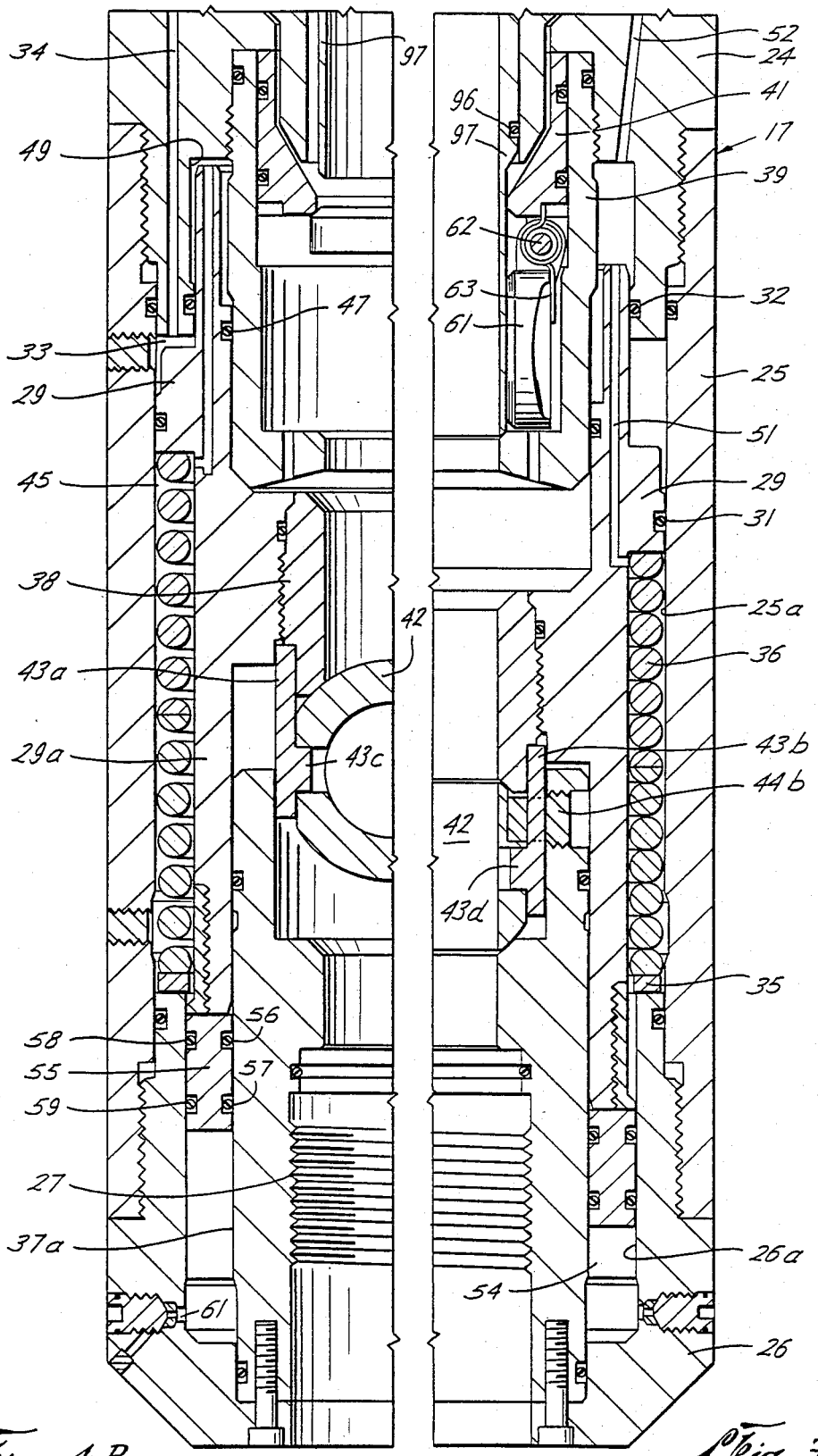
Figures 9, 10A, 10B:
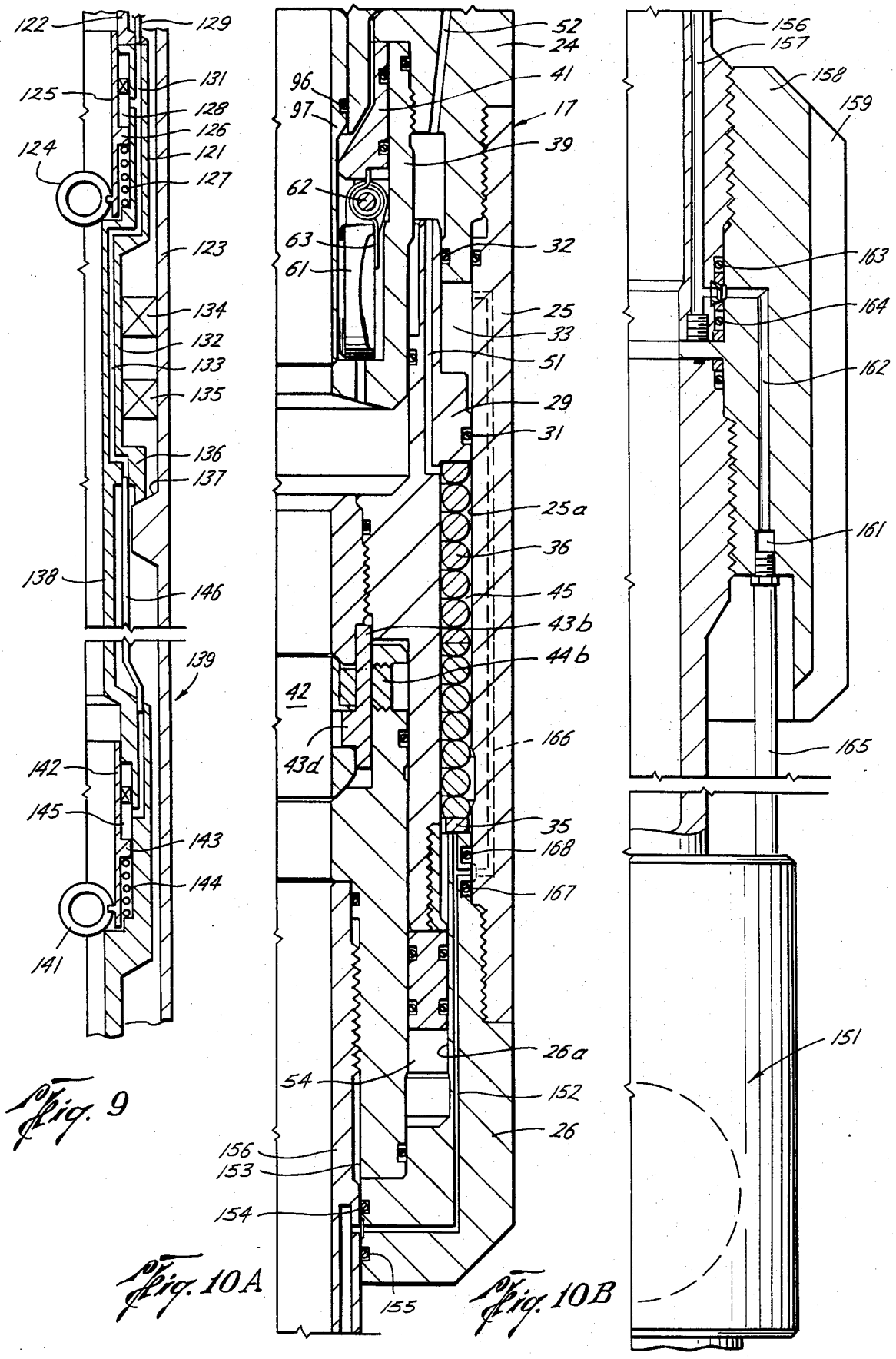
FIG. 9 is a schematic view illustrating the combination of a test tree and a subsurface safety valve with the valve operated by the control pressure for the test tree.

FIG. 10A is a view similar to FIG. 3B showing in quarter-section a fragment of the lower section of the tree and of the slick joint secured thereto and the manner in which hydraulic fluid may be conducted from either the control chamber or the balance chamber to the slick joint; and FIG. 10B is a view partly in section and partly in elevation illustrating the lower end of the slick joint, the fluted hanger and subsurface safety valve which are suspended from the test tree.

Figure 1:
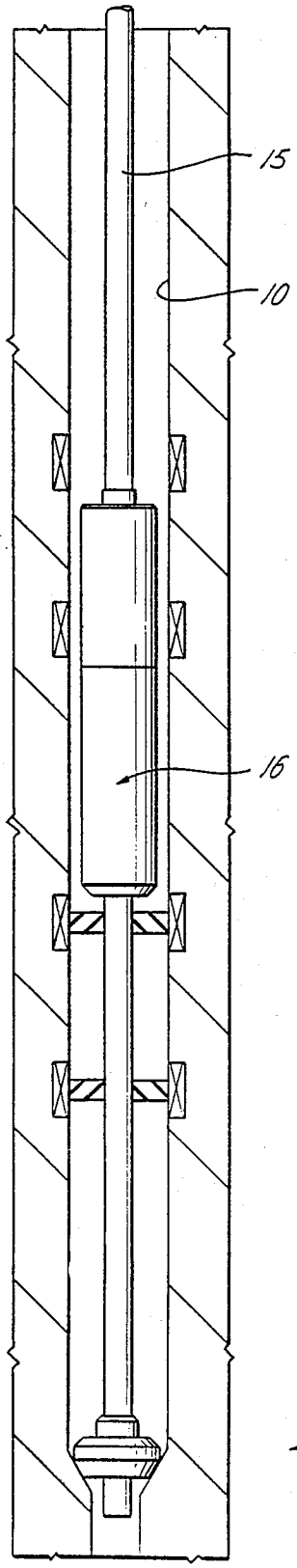
FIG. 1 is a fragmentary schematic view through a blowout preventer stack showing the subsurface test tree of this invention landed in the tree below the blind rams of the blowout preventer stack.
Figure 2:
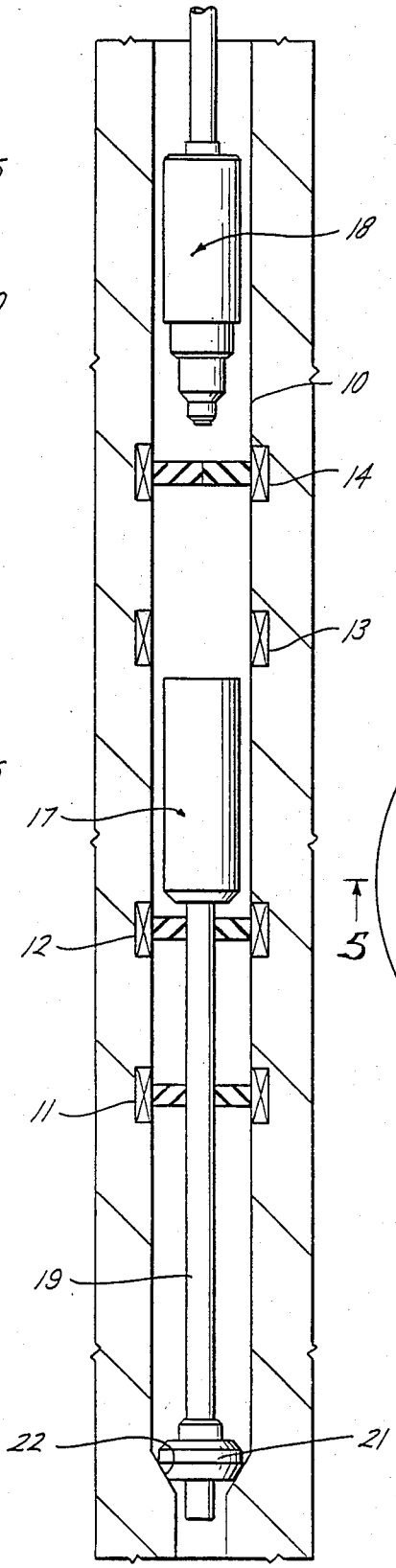
FIG. 2 is a view similar to FIG. 1 in which the stinger of the tree is shown released from the valve housing and being moved upwardly in the blowout preventer stack to pull it from the stack and the upper or blind rams to be closed above the valve housing to shut-in the well.

Referring first to FIGS. 1 and 2, there is shown at 10 the bore through a blowout preventer stack. This stack would conventionally be made up of several blowout preventers, each having rams. Such rams are shown at 11, 12, 13 and 14. The lower rams are conventionally used to control the injection of fluids into the annulus. The uppermost blowout preventer carrying the rams 14 normally employs blind rams which close the bore through the blowout preventer completely instead of closing around a pipe, such as does the blowout preventer ram 11. The upper rams 14 may also be of the shear type which are capable of shearing a production tubing, such as tubing 15 on which the test tree is suspended, so that in emergency the shear rams may be closed cutting the production tubing and control cables and the like free from the test tree. The shear rams close above the test tree and close in the blowout preventer stack, as is well known to those skilled in the art.

The test tree indicated generally at 16 is of a very short vertical dimension so that the entire test tree may be mounted below the shear ram 14. This short vertical dimension also permits the valve housing section 17 of the test tree to be positioned in the well below the blind rams of substantially any conventional blowout preventer stack configuration so that the stinger portion 18 of the tree may be disengaged and removed from contact with the valve housing portion of the tree to permit the blind rams 14 to be closed above the housing as shown in FIG. 2 to shut-in the well at any time circumstances indicate to the operator that the wellhead should be disengaged.

As indicated schematically in FIGS. 1 and 2, the test tree 16 may be positioned in the well in any desired manner. For instance, the test tree 16 is mounted on a slick tubing section 19 which is in turn carried by a spider 21. The spider 21 is supported on the shelf 22 in the wellhead and blowout preventers carrying rams 11 and 12 may be closed about the slick tubing 19 to control the well annulus.

Figure 6:
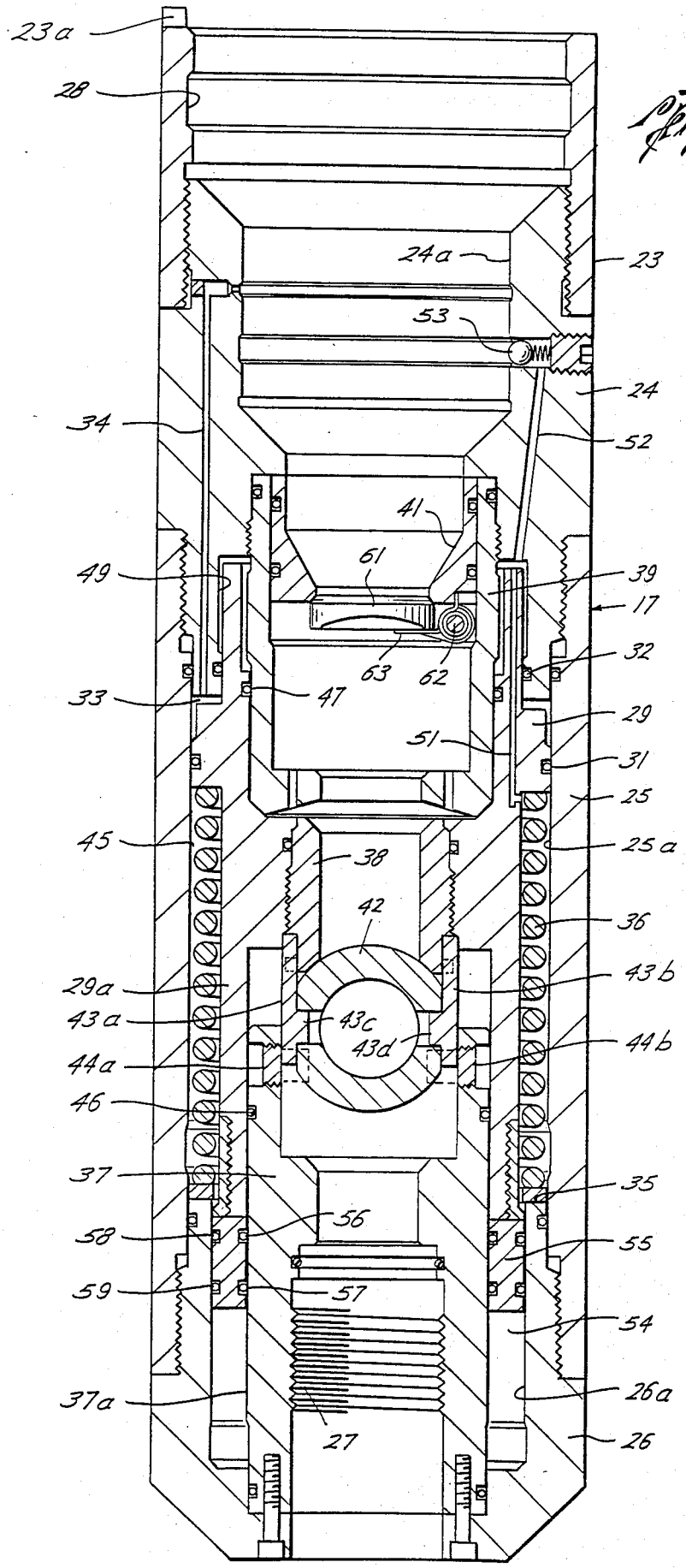
FIG. 6 is a vertical cross-sectional view of the lower valve housing section of the test tree.

Reference is first made to FIG. 6, illustrating section 17 of the test tree which remains in the well when the stinger 18 is disconnected and withdrawn. This lower section 17 includes a housing made up of a latch ring 23 on its upper end which is connected to an intermediate latch sub 24. Below the latch sub 24 the housing includes the spring housing 25 and the bottom sub 26. The valve housing is generally tubular in form and is adapted to connect to the slick tubing 19 through threads 27.

At the upper end of the housing the latch ring 23 is provided with a groove 28 which receives latch means of the stinger as will appear hereinafter.

The spring housing 25 is provided internally with a slick bore **25*a* which provides a cylinder in which the operating piston 29 reciprocates. Suitable seal means, such as the O-ring 31, seals between the piston 29 and the cylinder 25*a*. O-ring 32 seals between the piston and latch sub 24 to provide a chamber 33 above the piston 29. This chamber is connected to the control fluid conduit 34 for providing control fluid to the upper surface of piston 29 to force the piston 29** downwardly.

Within the cylinder a spring support 35 is provided by the upper end of the lower sub 26.

A spring 36 extends between the spring support 35 and the piston 29 and urges the piston 29 upwardly against the force exerted by pressure fluid within the control chamber 33. Thus, in the conventional manner the control of pressure within the control chamber 33 results in reciprocation of the piston 29 in response to the forces exerted by this pressure and spring 36. As will appear hereinafter, a pressure dome is also utilized which is effective on the piston but if the pressure dome is omitted or becomes inactive, as by a leaking seal, the piston will be controlled by the interaction of pressure within chamber 33 and spring 36. Of course, the pressure dome could be omitted and the piston would be controlled solely by the difference between pressure within the chamber 33 and the force of spring 36 if no balance provision be made. In accordance with this invention provision is made for balancing the hydrostatic head of fluid in the control line so that the tree may be used at any desired depth, as will appear hereinafter.

A flow conduit extends through the housing for the well fluids being produced. This flow conduit is provided by an internal bore through the ball support 37 at the lower end of the structure, the connecting rod 29*a* which depends from the piston 29, the ball seat 38, the flapper housing 39, flapper seat 41, and the bore 24*a* within the latch sub 24. This flow conduit includes a portion which is arranged radially inwardly from the spring 36. In the illustrated form this portion includes the upper end of the ball support 37 and extends upwardly to the piston 29.

Figure 8:
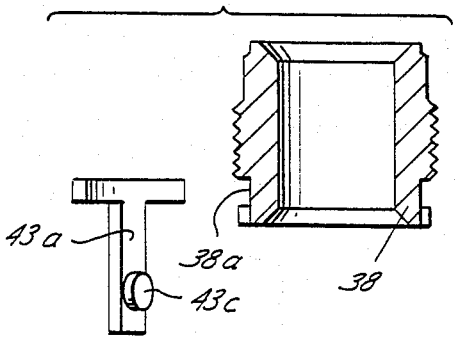
FIG. 8 is an exploded view of a control arm and the lower valve seat.
Figure 7:
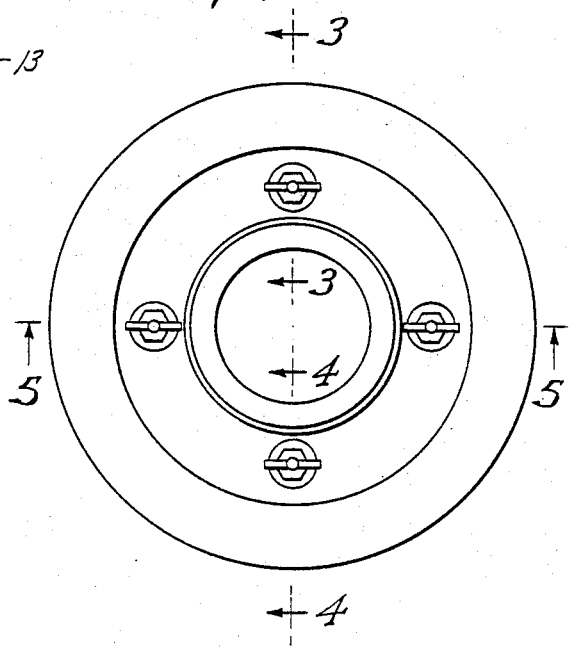
FIG. 7 is a top plan view of the test tree of this invention.

Within this portion of the flowway, that is, surrounded by the spring, the tree is provided with a valve means such as ball valve member 42 which sealingly engages the lower end of seat 38. The ball seat 38 is carried by the connecting rod 29*a* and control arms 43*a* and 43*b* extend downwardly from the seat 38 on either side of the ball 42 and have inwardly extending pins 43*c* and 43*d* on which the ball 42 is journalled in the conventional manner so that in the conventional manner reciprocation of piston 29 will cause the ball 42 to rotate between open and closed positions. FIG. 8 illustrates that the seat has an annular external groove 38*a* in which the circumferentially extending cross portion of the T-shaped control arms are received to positively reciprocate the ball 42. In the conventional manner the ball is also journalled on pins 44*a* and 44*b* which are carried in the ball support 37. The ball is provided with slots shown in dashed line which cooperate with the pins 44*a* and 44*b* to effect such rotation. To provide for a very short test tree the valve member 42 is arranged so that it is positioned at least in part within the portion of the flowway that is surrounded by the spring 36. In the illustrated form the ball and the surface of seat 38 engaged by the ball are positioned entirely within the portion of the flowway that is radially inwardly from the spring, that is, above the spring support 35 and below the piston 29. By this arrangement the vertical dimension which is critical to the provision of a very short tree may be minimized and ample power provided by direct massive connection between the piston and valve to force the valve to close position to cut a wireline or other communicating or supporting structures which may be extended through the ball valve.

As indicated above, it is preferred to provide for balancing the force exerted by the hydrostatic head of fluid in the control line from the surface down to the control chamber 33. For this purpose the chamber 45 below the piston 29 acts both as a spring chamber and as a balance chamber. The connecting rod 29*a* telescopes over the ball support 37 and a suitable seal such as the O-ring 46 provides a sliding seal therebetween. This seal in cooperation with the piston seal 31 provides a fluid chamber 45 for balancing the fluid in control chamber 33. The piston telescopes about the flapper housing 39 and a sliding seal such as O-ring 47 seals between the piston and the flapper housing. This sliding seal 47, together with the seal 32 between the sub 24 and the piston 29 isolate the bore 49 within the sub 24. Communication is provided between the bore 49 and the balance chamber 45 by a passageway 51 which extends through the piston 29. A balance fluid conduit 52 communicates with the passageway 51 through the piston and conducts balance fluid pressure from the surface to the balance chamber 45. Thus, the pressure in the control chamber 33 and in the balance chamber 45 due to the hydrostatic head of fluid above the piston may be balanced. By arranging the several seals so that the areas exposed to balance fluid and to control fluid are equal and opposite, as is shown in FIG. 6, these pressures are cancelled out and only the application of control fluid pressure to the control chamber 33 is effective to urge the piston 29 downwardly.

It will be noted that the upper end of the balance fluid conduit 52 includes a check valve 53 which is seated when the stinger is withdrawn, as shown in FIG. 6. Thus, pressure within the balance chamber is trapped and cannot escape the chamber. This is done to prevent fluid escaping through the tree when there is a failure of a dynamic seal. It will be noted that each dynamic seal between the piston and other structure seals between the balance chamber 45 and other pressure, such as the control pressure in chamber 33 or the pressure within the flowway. If one of these seals fails, the pressure being sealed against escapes into the balance chamber. This is particularly significant when sealing against pressure within the tubing below the tree. If seal 46 or seal 47 fails the failure is into the balance chamber. This tends to urge the valve member 42 toward full closed position and the check valve 53 at the upper end of the balance fluid conduit 52 checks against the loss of this pressure from the second fluid conduit. Thus, the failure of a dynamic seal will not permit the pressure within the well bypassing the valves in the housing and the pressure will be contained even in the case of a failing seal.

In accordance with this invention it is desirable that the tree be provided with the capability of cutting through structures such as a wireline or a slick line which may be suspended within the tree. As such a line may extend thousands of feet down into the well, there may not be time to withdraw this line prior to making an emergency disconnect. Thus, it is preferred that the ball valve 42 be capable of cutting such structures on closure. For this purpose the closure spring 36 exerts a strong force directly on the piston 29 in a direction to cut such a line with a reduction in pressure in the control chamber 33. To assist the spring in providing a high closing force, a pressure dome 54 is provided. This dome 54 has a floating piston 55 therein having spaced annular internal seals, such as O-rings 56 and 57, and spaced external seals, such as O-rings 58 and 59. This piston is reciprocal within the bore 26*a* in the lower sub 26 and about the outer cylindrical surface 37*a* of the ball support 37. The piston 55 bears against the lower end of the connecting rod 29*a* and thus pressure within the pressure dome 54 urges the piston 55 upwardly to apply an upward force to the connecting rod and the piston 29 to move the valve 42 to full closed position.

It is preferable that the dome 54 be charged with an inert gas through a charging port 61 (FIG. 3B). The gas may be any desired gas, but it is preferably inert and as nitrogen is a ready source of inert gas it is preferred. Nitrogen has the capability, however, of migrating past O-rings and for this reason the space surrounding the piston 55 between the O-rings carried by the piston is charged with water as this water will provide a barrier to the migration of nitrogen through the O-ring seals. The action is not understood, but it is known that water between the seals will prevent the migration of nitrogen. In charging the chamber the piston is positioned at the bottom of the sub 26 and water charged into the space between the two sets of seals. Thereafter, the chamber is charged with nitrogen to the desired pressure. Thus, the pressure within the dome 54 and the force exerted by the spring 36 are effective in an upward direction against the piston 39. This force is overcome by pressure applied in the control chamber 33 to shift the piston downwardly and open the valve. It will be seen that several thousand pounds of pressure may be applied through the pressure dome and as the spring 36 is of a large diameter these two structures will exert considerable force on the ball 42 and force it to closed position, even though there may be a wireline extending through the valve member 42. As the valve member 42 rotates to its closed position, it will cut the wireline and move to full closed position.

In the illustrated embodiment the balance pressure opposes dome pressure. The dome may readily be charged to a sufficient pressure to overcome balance pressure and provide the desired force for cutting a line or coil tubing.

In the event pressure is lost from the pressure dome 54, then additional force may be supplied to assist the spring 36 in moving the ball valve 42 to its full closed position by pressurizing the balance chamber 45. This provides a back up system so that the operator can always be assured that the ball valve can be forced to full closed position and cut a wireline or the like which may extend therethrough.

For example, if dome 54 is charged to 500 psig, at least 1000 psig of control line pressure must be exerted on piston 29 to open ball 42. The exact pressure ration depends upon the area of piston 29 as compared to piston 55. When control fluid is first injected at the surface, control fluid pressure increases to between 50 and 100 psig and fluctuates at this level while spring 95 is compressed to open flapper 61. The control pressure is not constant due to pump surges but is limited to a relatively low value by spring 95. When flapper 61 is fully opened, control pressure at the surface builds up rapidly to 1000+ psig. At this higher pressure, piston 29 will start to rotate ball 42 open. While ball 42 is opening, control pressure fluctuates at this higher level. When ball 42 is fully open, control pressure at the surface increases rapidly to the maximum limits of the hydraulic pump and accumulator. This sequence of control pressure build-up indicates proper valve opening. If dome 54 should be leaking, this characteristic pressure build-up is not present and the operator has an indication of dome leakage at the surface.

During closure of ball 42 and flapper 61, control fluid pressure should decrease in the opposite sequence at the well surface. Thus, this invention allows the operator to observe control pressure while opening and closing the subsurface tree to check for satisfactory performance of the various components within the subsurface test tree.

A secondary or back up valve means is provided by a flapper valve member 61. The valve member 61 is carried by the flapper seat 41 and is journalled for rotation about a pin 62 carried by a downwardly extending portion of the seat which is not shown. This downwardly extending portion of the seat positions the seat 41 in the position shown and prevents it from moving downwardly within the flapper housing 39. A spring 63 wraps around the pin 62 and bears against the seat and the flapper member to urge the flapper member 61 toward the closed position illustrated. Thus, when the bore through the seat is clear, that is, the stinger is removed, the flapper valve 61 will automatically move to closed position and provide a back up for the ball valve therebelow to provide a double valve containing the well pressure.

Figure 5:
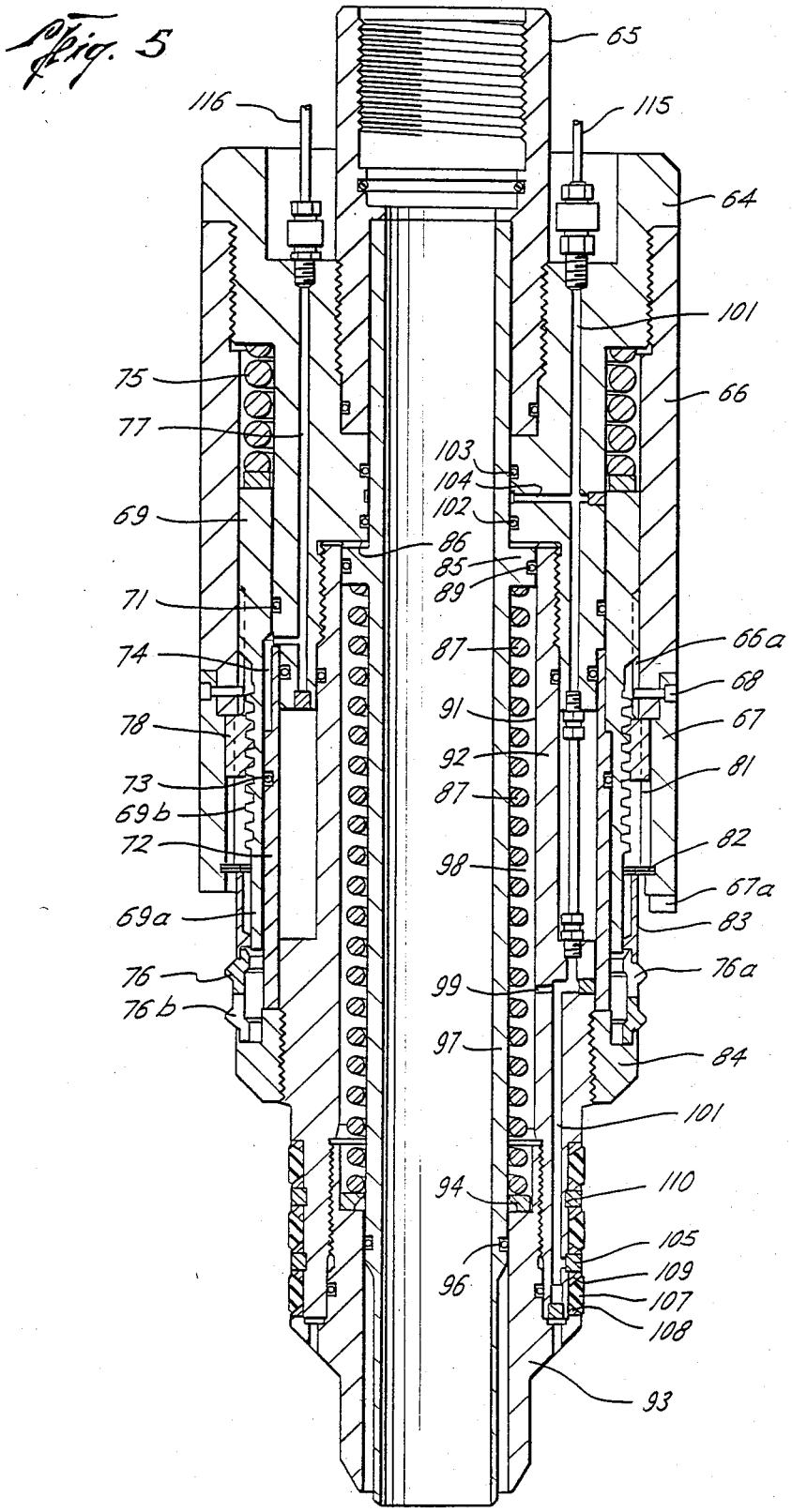
FIG. 5 is a view along the lines 5—5 of FIG. 7 showing in vertical cross-section the stinger portion of the test tree.

Reference is now particularly made to FIG. 5 in which the stinger or upper portion of the subsurface tree is illustrated. The stinger includes an upper body 64 which is suspended through the threaded connector 65 from the tubing extending to the surface. A latch body 66 extends downwardly as a skirt from the upper end of the upper body 64. A latch ring 67 depends from the latch body 66 and is secured thereto by shear pins 68.

Vertically reciprocal between the upper body 64 and the latch body 66 is the latch piston 69. A suitable seal such as the O-ring 71 seals between the upper body 64 and the latch piston 69. A sleeve 72 extends downwardly from the upper body 64 and has a slightly larger external diameter than the diameter of the upper body which includes the seal 71. The piston 69 is telescoped over the sleeve 72 and a suitable seal such as O-ring 73 is provided therebetween. This construction results in a latch fluid chamber 74 which when pressurized forces the piston 69 upwardly against the force exerted by spring 75.

Below the lower end of the piston 69 is a C-ring 76 which is shown in FIG. 5 in its unstressed condition. In this condition the ring will cooperate with the latch groove 28 in the latch housing (FIG. 6) to latch the stinger to the valve housing (see FIG. 3A). The C-ring is massive as it must transmit very substantial forces and it is relieved at circumferential points as shown at **76*a* and 76*b*** to permit it to expand and contract.

Pressure fluid is supplied to the chamber 74 through the latch conduit 77 to raise the piston to the position shown in FIG. 5 and permit the C-ring 76 to contract as the stinger is lifted out of engagement with the valve housing. When the latch conduit 77 is not under pressure the spring 75 will hold the prop-out **69*a* provided by the lower end of piston 69 in lowered position to prop the ring 76** in its radially outermost position and lock the stinger to the housing.

If for some reason the latch cannot be released hydraulically a mechanical release is provided. The exterior of the piston 69 at an intermediate section has threads **69*b* which are threaded onto a nut 78. As shown in dashed lines, this nut is splined to the spline 81 within the latch ring 67**.

This nut 78 is normally in the position shown in FIG. 3A and moves between the lower end of the latch body 66 and a spiral lock retainer 82 in the lower end of the latch ring 67. This spiral lock retainer 82 holds the spacer 83 in a position to hold the C-ring 76 in its supporting ring carrier 84, as shown.

The lower end of the latch ring 67 is provided with a lug **67*a* which engages an upstanding lug 23*a* on the upper end of the latch sleeve 23 on the valve body. By applying rotation to the upper body 24 the shear pins 68 will be sheared and the upper body and the latch body 66 will be rotated relative to the latch ring 67. A spline 66*a* is provided on the inner lower surface of the latch body 66 which engages with a slot in the latch piston 69**.

Thus, relative rotation between the latch body 66 and the latch ring 67 results in relative rotational movement between the latch piston 69 and the nut 78. The engagement of the threads on the nut and piston will drive the piston upwardly against the force of spring 75 to withdraw the prop-out 69*a* from behind the C-ring 76. This permits the C-ring to be collapsed and the stinger to be withdrawn from the valve housing.

Within the stinger there is provided a valve operator for opening and closing the flapper valve 61 in the valve body. This operator includes the piston 85 having a pressure chamber 86 thereabove for receiving pressure fluid to force the piston downwardly against the force exerted by the return spring 87. Operating fluid pressure is provided to the chamber 86 from the control conduit 88 in the stinger (see FIG. 3A).

The piston is provided with a suitable seal such as the O-ring 89 which seals between the piston and the internal wall of cylinder 91 of the spring housing 92. A lower stinger sub 93 is carried by the spring housing 92 and provides a spring stop at 94. A suitable spring 87 extends between the piston 85 and the spring stop 94 to urge the piston upwardly. A seal such as the O-ring 96 is provided between the stinger 97 which depends from the piston 85 and the bore within the lower stinger sub 93.

The pressure chamber 98 provided by the seals 96 and 89 communicates through port 99 with the balance fluid conduit 101. Balance pressure is exerted within the chamber 98. As the O-ring seal 102 between the upper extension above the piston and the upper body 64 and the seal 96 on the stinger have approximately the same diameter the effective area above the piston 85 is substantially the same as the effective area below the piston. Balance fluid exerted upwardly against the piston 85 will balance the effect of the hydrostatic head of fluid exerted on the upper surface of the piston 85. The piston 85 will reciprocate in response to the force exerted by the spring 95 and the control pressure applied to the chamber 86.

A second O-ring 103 seals between the extension above the piston 85 and the upper body 64. Between the seals 102 and 103 a branch conduit 104 communicates the area between these seals with the balance fluid conduit 101. A failure of any of the dynamic seals 96, 89, 102 or 103 results in bypassing fluid to the balance line. Thus, either the control fluid or the fluid flowing through the tree will, upon failure of a dynamic seal, be exerted in the balance line and result in closing of the valves.

The lower end of the stinger provides for communication between the control and balance fluid conduits in the housing and associated control and balance fluid conduits in the stinger. As shown in FIG. 5, the balance fluid conduit 101 terminates at its lower end beneath the C-ring 105. In like manner, the control fluid conduit is shown in FIG. 3A to have its exit beneath the C-ring 106.

Three seal assemblies straddle the outlets of the conduits 88 and 101 and cooperate with the latch sub 24 in the upper end of the valve body to provide for communication between the stinger control conduit 88 and the valve body control conduit 34. In like manner, communication is provided between the balance conduit 101 in the stinger and the balance conduit 52 in the valve body.

These seals are provided by resilient members 107 having molded thereto supporting metallic rings 108 and 109.

The C-rings 105 and 106 reside within grooves 111 for the upper C-ring 106 and 112 for the lower C-ring 105. By providing the C-rings within the grooves the force exerted on one packing is transmitted directly to the spring housing instead of being permitted to stack from one ring to the next ring. This objective has been accomplished before with much more complex structure and the use of C-rings to prevent the force applied to one packer from being exerted on the next permitted the stinger to be reduced in length several inches.

Provision is made for injecting fluid into the well through the test tree. An injection flowway 111 extends downwardly through the stinger and terminates at its lower end in an exit port 111*a* (see FIG. 4A). As the injection conduit is open to fluids within the well, a pair of check valves indicated generally at 112 prevent well fluids from flowing in a reverse direction through the injection flowway 111, thus protecting against loss of well fluids in the event of a rupture in the conduit extending from the surface down to the test tree.

In FIGS. 3A and 4A the control line 88 and the injection line 111 are shown at their upper ends to have shut off valves 113 and 114 instead of the lines which extend to the surface as shown in FIG. 5 at 115 and 116, communicating the latch conduit 77 and the balance conduit 107 with the surface. These are shown in FIGS. 3A and 4A to illustrate closing of these lines during the non-use of the tree. These closures 113 and 114 would also substitute for the conduits 115 and 116 shown in FIG. 5 while the tree is stored between uses. When the tree is in use conduits such as 115 and 116 would replace the closures 113 and 114 of FIGS. 3A and 4A to connect the flowways 111 and 88 with control equipment above.

In operation the test tree is made up as a part of the production string utilized to test a well. The production string is run through the blowout preventer in the usual manner and landed on the supporting shoulder 22 in the wellhead. The operator may space the various blowout preventers of the blowout preventer stack as desired and the polish string 19 below the test tree may be selected to position the test tree at the desired level within the blowout preventer stack. The test tree is very short in vertical dimension and in any standard blowout preventer may be landed such that at least the valve housing 17 will be below the upper blanking ram 14. In most instances the entire tree may be landed below the blanking ram as illustrated in FIG. 1.

During running of the string, control lines such as lines 115 and 116 will extend from the tree to the surface and connect each of the balance, control, latch, and injection passageways to the surface.

After the string is landed the blowout preventers 11 and 12 may be closed about the slick joint 19 and such testing of the system as desired may be carried out.

When it is desired to produce the well, the control conduit 113 will be pressurized to a pressure sufficient to overcome the force exerted by the upper control spring 87, the lower control spring 36 and the charge within the chamber 54 so that both operating pistons will be driven to their lower position shown in FIGS. 3A and 3B to open the flapper valve 61 and the ball valve 42, permitting production through the test tree. In normal operation the test tree will remain open until production testing is completed and then will be removed from the blowout preventer in the conventional manner as the test string is retrieved.

In the event of abnormal conditions, such as a sudden severe storm, the operator may release the test string and shut-in the well. Under severe emergency conditions where the upper ram 14 is a shear ram, this ram may be closed parting the upper string 15 and the control lines to shut-in the blowout preventer stack above the test tree. Severing of the several control lines will result in equalization of pressures across the operating pistons 85 and 29. When the pressure above the upper piston 85 equalizes the spring 95 will drive the piston to its upper position shown in FIG. 4A and the spring 63 associated with the flapper valve will move the flapper valve to full closed position. At the same time the piston 29 in the valve body will move to its full up position shown in FIG. 4B closing valve member 42 to the position shown in FIG. 4B. Assisting in the closing action, of course, is the pressure dome and its piston 55 which are also at this time exerting an upward force against the connecting rod 29*a*. Thus, the test tree will fail safe and will shut-in the tubing below the tree. After the emergency is over, conventional retrieval operations may be carried out to bring the tree to the surface to connect it to a new upper production tubing and new control lines and the test operation continued.

If circumstances will permit, the stinger is disengaged and removed. Even in sudden storm conditions there will normally be an opportunity to remove the stinger and this operation may be quickly carried out to shut-in the well and retrieve the stinger and upper tubing until such time as the emergency conditions have abated.

In releasing the stinger from the valve body the pressure within the control line 88 is removed permitting the pressure across the upper piston 85 and the lower piston 29 to bleed down toward or to the same hydrostatic pressure which is exerted in the balance chambers 98 and 45 below the two pistons. As the pressure bleeds down, the two springs 87 and 36 are urging the two pistons upwardly. Also, at the same time, the charge chamber floating piston 55 is being urged upwardly by the pressure within dome 54 to move piston 29 upwardly. The force exerted by the pressure dome and the lower spring 36 are relatively greater than the force exerted by the upper spring 87 and the lower piston will be moved to its full upper position prior to the piston 85 being moved to a position clearing the flapper valve 61. If a wireline or the like is present in the test tree, the closing of ball valve 42 will sever the wireline as the ball valve closes. The operator can be reeling in the wireline at the same time that the control pressure is removed and the moment that it is severed the free end of the wireline will be pulled above the flapper valve 61. Thereafter, the flapper valve 61 will close as the piston 85 moves to its full upper position permitting the flapper valve to be closed by the spring 63. In the event the wireline has not cleared flapper 63 the pressure differential across the flapper should not be substantial and the operator should be able to pull the wireline through the partially closed flapper and seat to clear the flapper and permit it to move to full closed position.

The latch may be released by pressurizing the latch conduit 77 while the control conduit is being bled down or after the control conduit has been bled down. In either event pressure will drive the latch piston 69 upwardly to pull the prop- out 69*a* from behind the C-ring 76. After this has been accomplished the stinger may be lifted vertically from the housing, as illustrated in FIG. 2, to permit the blind rams 114 to be closed above the valve housing 17, thus shutting in the well. The stinger and the upper production tubing 15 may be moved to the surface, leaving the test string which is left in the well with the valve housing 17 to control the well while the stinger is disengaged.

Mechanical disengagement is provided for in the event the stinger cannot be released by hydraulic operation as, for instance, where the control line has been damaged. In this event the upper tubing 15 and the stinger are rotated to shear pins 68. Due to the engagement of the dog 67*a* with the corresponding dog 23*a* on the valve body, the latch ring will be held against rotation while the latch piston 69 will be rotated. Downward movement of the nut 78 is prevented by the spiral lock 82 and thus the threaded piston 69 will be forced to rise against the force of spring 75 to move the latch prop-out 69*a* from behind the C-ring 76 to its disengaged position. Thereafter, the stinger may be lifted free of the valve body and the blind rams 14 closed above the valve body.

When it is desired to recommence operations the stinger is run with the latch control conduit 77 pressurized to hold the piston 69 in its upper position where the prop-out 69*a* will not interfere with operation of the C-ring 76. The stinger is stabbed into the top of the valve body to engage in the latch groove 28. Thereafter, the pressure within the latch conduit 77 is removed and the spring 75 drives the latch piston 69 down to position the prop-out 69*a* behind the C-ring 76 and latch the stinger to the valve body. Thereafter, the control conduit may be pressurized to open the two valves and recommence testing operation.

While the stinger is disengaged the valve body and its associated valves and assembly will be in the position shown in FIG. 6. In this condition the control conduit 34 is exposed as is the balance conduit 51, except for the action of the check valve 53. Thus, if the pressure within the control conduit 34 is less than the pressure within the balance conduit 52, the balance pressure will be urging the lower piston 29 toward closed position. At this time also the pressure dome 56 will be exerting pressure through its piston 55 to move the piston 29 to upper valve closed position. Also, the spring 36 is urging the piston in the same direction. In the event the pressure above the valve body is greater than the pressure in the balance chamber, the ball 53 will unseat and permit this pressure to be exerted within the balance chamber, thus balancing the pressure within the control chamber. It results that under any pressure conditions the force of the spring 36 and the pressure within dome 54 will be urging the ball valve to full closed position. Also, the spring 63 will be urging the flapper 61 to full closed position.

In the event of a failure of any of the dynamic seals this failure will be into the balance system and well pressure will be exerted upwardly on the piston 29 to hold it in full up ball closed position.

When the stinger is engaged and a failure occurs in the dynamic seals of either the valve assembly or the stinger assembly, well pressure again will be directed into the balance system and will be exerted in a direction to force the two operative pistons to their upper valve closing position, shutting in the well until remedial action can be taken.

In some instances it is desired to flow the well through the test tree for a sufficient length of time that it is desirable to provide for positive control by a subsurface safety valve which is controlled from the surface to guard against the well being permitted to flow after the occurrence of an undesirable event at the surface. It is common practice to utilize a surface control subsurface safety valve in the production of offshore wells. In accordance with this invention such control is provided for without interfering with or losing any of the standard functions of the test tree and without adding any additional fluid conduits from the surface down to the tree and through the tree to the subsurface safety valve.

Referring first to FIG. 9, there is shown schematically a test tree having a lower section 121 and an upper section 122 landed in the blowout preventer 123. The upper and lower sections would be latched together by means which are not shown.

The lower section of the tree includes a valve 124 rotated between open and closed position by a valve operator 125 which carries a piston 126. The piston is urged upwardly by the spring 127 and downwardly by fluid pressure within the control chamber 128. Fluid to the control chamber is provided from the surface through conduit 129 which is in fluid communication with the conduit 131 in the lower body 121.

In the practice of this invention as it pertains to the combination of the test tree and the subsurface safety valve, any desired form of test tree may be utilized and, if desired, the control fluid pressure within the conduit 131 may be utilized to operate the subsurface safety valve, as shown in FIG. 9. Preferably, however, the subsurface safety valve will be operated from balance pressure fluid in those instances in which a balance fluid is utilized, as will be described in FIGS. 10A and 10B.

The tree has depending therefrom a slick joint 132 which is pierced to provide a flowway 133. The purpose of the slick joint is to provide a surface against which the blowout preventers, illustrated schematically, 134 and 135 may be effective to seal the annulus between the wellhead and the tree.

At the lower end of the slick joint is a fluted hanger 136 which rests on the shoulder 137 in the wellhead to support the test tree.

Depending from the fluted hanger 136 is the well tubing 138 which has therein a subsurface safety valve, indicated generally at 139, which may take any desired form. In the illustrated valve the valve member 141 is rotated between open and closed positions by the actuator tube 142 which is reciprocated in response to movement of piston 143. The piston 143 is reciprocated upwardly by spring 144 and downwardly by pressure within the chamber 145. In accordance with this invention the conduit 146 which supplies pressure fluid to the subsurface safety valve chamber 145 receives its fluid from the conduit 131 in the test tree which provides control fluid for the test tree valve 124.

With this system the other conduits which are commonly found in a test tree may carry out their conventional function, such as the chemical injection flowway may be used for chemical injection.

In operation the pressure within the conduit 129 extending to the surface will be maintained at a sufficient level to maintain the valve 124 of the test tree and the valve 141 of the subsurface safety valve in open position while the well is being produced. If it is desired to remove the upper section 122 of the test tree, or if some accident occurs at the surface which results in the automatic controls at the surface reducing the pressure in control line 129, the two springs 127 of the test tree and 144 of the subsurface safety valve will be effective to move both valves to the closed position.

In the event that the upper section 122 of the tree is removed, this will automatically result in closing of both the test tree valve member 124 and the subsurface valve member 141.

It will be understood that the test tree is illustrated schematically and may take any desired form, such as the form illustrated in this application, or the form shown in those patents and publications referred to hereinabove. Subsurface safety valves are well known and many different designs are known and used. Any desired subsurface safety valve may be used in this system.

Reference is made to FIGS. 10A and 10B in which the preferred form of this aspect of the invention is illustrated. The structure in FIG. 10A is identical to the structure in FIG. 3B with the exception of the flowways from the balance and control chambers to the subsurface safety valve and will not be redescribed.

In order to conduct balance fluid to the safety valve indicated generally at 151, the lower closure 26 of the lower section of the test tree has a passageway 152 extending from the upper end of the closure to the bore 153 through the closure. A pair of suitable O-rings 154 and 155 straddle the outlet of the passageway 152 into the bore 153 to confine fluid between the closure and the tubing 156 depending therefrom. The tubing 156 is a slick joint for engagement by blowout preventers as above noted. The wall of the tubing is pierced at 157 to provide a flowway through the slick joint conducting balanced fluid downwardly.

At the lower end of the slick joint a coupling 158 provides a fluted hanger adapted to support the tree in a wellhead. Flutes 159 provide for flow of fluid in the wellhead past the hanger 158.

The coupling 158 is provided with a port 161 and a flowway 162 extends from the port 161 to the inner bore of the coupling 158 where it communicates with the slick joint. O-rings 163 and 164 seal between the two conduits 162 and 157.

A conduit 165 extends downwardly from the port in the fluted hanger and conducts fluid to the safety valve 151 to control opening and closing of the safety valve in the conventional manner.

In the event it is desired to use the control fluid pressure to operate the safety valve 151, the tubular housing 25 may have a passageway therein as indicated in dashed lines at 166 communicating the control chamber 33 with the passageway 152 in the lower closure. An additional O-ring 167 would be provided below O-ring 168 and below the passageway shown in dotted lines to straddle the connection between the dotted line passageway and the passageway 152. Also, where control fluid pressure is utilized a plug would be provided in the upper end of passage 152 to isolate the passageway from the balance fluid pressure. Application of sufficient control fluid pressure to open the tree valves would open the safety valve and removal of this pressure would close all valves.

While either type of control may be utilized, that is, control fluid or balance fluid, to operate the safety valve, it is preferred to utilized balance pressure as this will permit the independent operation of the subsurface control valve without operation of the valves in the test tree. Operating the system in this manner requires that in addition to the hydrostatic head of fluid being imposed in the balance chamber 45, an additional pressure would be imposed which would operate the subsurface safety valve and when this additional pressure was removed the subsurface safety valve would move to closed position. This would require that a greater pressure would be used in the control chamber 33 to move the piston 29 downwardly, but this presents no serious problem.

Of course, the pressures at the desired levels must be maintained on the balance fluid chamber and on the control fluid chamber while at the same time not providing a fluid lock which would prevent the pistons reciprocating against the pressure fluid. It is conventional in systems of this sort to provide a control system at the surface which has an accumulator with a gas cushion therein and the control system maintains the desired pressure on the accumulator. With this conventional type of surface equipment, the control piston 29 can be reciprocated as needed without danger of a fluid lock preventing such reciprocation due to the use of the accumulator. As both the control chamber and the balance chamber would be held under pressure exceeding the hydrostatic head of fluid extending from the test tree to the surface, the standard accumulator circuit would be used to maintain pressure in both the balance and control lines.

Of course, other types of control systems might be utilized, such as pressure relief valves which would retain the desired pressure while permitting passage of the amount of fluid displaced by reciprocation of the piston. Such equipment is not illustrated in the drawings as it is a form of standard equipment utilized with test trees.

If the test tree utilizes the back check valve 53, pressure will be trapped below this point when the upper section of the test tree is removed. If the upper section of the tree is removed while the subsurface safety valve is held in open position, the action of the back check in seating and blocking loss of fluid from the passageway will hold the subsurface safety valve in open position. If it is desired to have the subsurface safety valve closed, the excess pressure in the balance chamber should first be removed to close the subsurface safety valve before the upper section of the test tree is removed. If this sequence of operation is followed, both the subsurface safety valve and the test tree valve means will be closed when the upper section of the test tree is removed.

If in an emergency situation the blind rams are closed above the tree to sever the tubing connecting the tree to the surface, all of the conduits leading to the surface will additionally be severed and pressure will be removed from the control chamber and from the balance chamber. This will result in both the subsurface safety valve and the tree valve means moving to closed position.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A subsurface test tree adapted to be suspended in a blowout preventer stack comprising, a tubular valve housing, a cylinder in said housing, a spring support in said cylinder, a piston slidable in said cylinder, spring means extending between said spring support and said piston and urging said piston in one direction, a flow conduit providing a flowway extending axially through the housing and having a portion arranged radially inward from said spring means, first valve means including a valve member on the spring side of said piston and positioned at least in part in the portion of the flowway surrounded by said spring means and between said spring support and piston in at least one position of the valve member, said valve means connected to said piston and controlling flow through said flowway in response to reciprocation of said piston, a control fluid conduit in said body extending from the side of the piston opposite said spring means, a stinger, means for releasably latching said stinger to said valve housing, a control fluid conduit in said stinger communicating with the control fluid conduit in said body when said stinger is latched to said valve housing, a tubing depends from said housing, a hydraulically operated surface controlled subsurface safety valve in said tubing, a hydraulic line for providing operating pressure fluid to said safety valve between said safety valve and a port in said housing, and means in said housing establishing fluid communication between said port and said control fluid conduit.

2. The test tree of claim 1 wherein annular seal rings are carried on said stinger between the stinger and housing on opposite sides of the communication between the stinger control fluid conduit and the housing control fluid conduit, and a C-ring is carried in a square shouldered groove in the stinger between said seal rings.

3. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, first valve means positioned radially inward of said tubular connecting rod, said valve means connected to said connecting rod and controlling flow through said housing in response to reciprocation of said piston, said valve means having a valve member located between said spring support and piston in at least one position of the valve member, a control fluid conduit in said body extending from the side of the piston opposite said spring means, a stinger, means for releasably latching said stinger to said valve housing, a control fluid conduit in said stinger communication with the control fluid conduit in said body when said stinger is latched to said valve housing, a tubing depends from said housing, a hyraulically operated surface controlled subsurface safety valve in said tubing, a hydraulic line for providing operating pressure fluid to said safety valve between said safety valve and a port in said housing, and means in said housing establishing fluid communication between said port and said control fluid conduit.

4. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, first valve means positioned radially inward of said tubular connecting rod, said valve means connected to said connecting rod and controlling flow through said housing in response to reciprocation of said piston, said valve means having a valve member located between said spring support and piston in at least one position of the valve member, a control fluid conduit in said body extending from side of the piston opposite said spring means, a stinger, means for releasably latching said stinger to said valve housing, a control fluid conduit in said stinger communicating with the control fluid conduit in said body when said stinger is latched to said valve housing, a pressure dome in said valve housing, and a piston exposed to pressure in said dome urging the connecting rod toward valve closing position.

5. The test tree of claim 4 wherein, a tubing depends from said housing, a hydraulically operated surface controlled subsurface safety valve is provided in said tubing, a hydraulic line for providing operating pressure fluid to said safety valve extends from said safety valve to a port in said housing, and means in said housing establishes fluid communication between said port and said control fluid conduit.

6. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, and a check valve preventing flow from said balance chamber when said stinger is removed from said valve housing, said check valve held unseated by said stinger when said stinger is latched to said valve housing.

7. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger is communicating with the control fluid conduit in said body when said stinger is latched to said valve housing, a balance fluid conduit in said stinger communicating with said balance fluid conduit in said body when said stinger is latched to said valve housing, a pressure dome in said valve housing, and a piston exposed to to pressure in said dome urging the connecting rod toward valve closing position.

8. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, second valve means in said housing above said first valve means, means in said housing urging said second valve means toward closed position, and valve operator means carried by said stinger and operable to move said second valve means to open position and movable to an out of the way position to permit said second valve to be moved to closed position by said urging means.

9. The test tree of claim 13 wherein said valve operator means is exposed to fluid in said control and balance fluid conduits in the stinger, said first valve means is provided by a ball valve, a pressure dome is provided in said valve housing, and a piston exposed to pressure in said dome urges the connecting rod toward valve closing position, whereby the first valve will closed and sever a line extending through the first valve prior to closing of the second valve.

10. A flow control system comprising, a test tree having upper and lower sections releasably secured together, valve means in said lower section, piston means in said tree controlling operation of said valve means, hydraulic passageway means in said tree in fluid communication with said piston and with a port opening to the exterior of said tree, a tubing depending from the lower section of the tree, a hydraulically controlled safety valve in said tubing, and conduit means providing fluid communication between said port and safety valve.

11. The flow control system of claim 10 wherein, the hydraulic passageway means includes a control pressure passageway and a balance pressure passageway, and said port is in fluid communication with one of said control and balance fluid passageways.

12. A flow control system comprising, a test tree having upper and lower sections releasably secured together, valve means in said lower section, piston means in said tree controlling operation of said valve means, hydraulical passageway means in said tree in fluid communication with said piston and with a first port opening to the exterior of said tree, a tubing depending from the lower section of the tree, a hydraulically controlled safety valve in said tubing, conduit means providing fluid communication between said port and safety valve, said tubing including a slick joint pierced to provide a flowway in the wall thereof depending from the lower tree section, and a coupling providing a fluted hanger depends from said slick joint, said coupling having a second port and means establishing fluid communication between said second port and the flowway in said slick joint, said slick joint flowway, second port and means establishing fluid communication therebetween providing a part of said conduit means.

13. The flow control system of claim 12 wherein, the hydraulic passageway means includes a control pressure passageway and a balance pressure passageway, and said first port is in fluid communication with one of said control and balance fluid passageways.

14. A subsurface test tree adapted to be suspended in a blowout preventer stack comprising, a tubular valve housing, a cylinder in said housing, a spring support in said cylinder, a piston slidable in said cylinder, spring means extending between said spring support and said piston and urging said piston in one direction, a flow conduit providing a flowway extending axially through the housing and having a portion arranged radially inward from said spring means, first valve means including a valve member on the spring side of said piston and positioned at least in part in the portion of the flowway surrounded by said spring means and between said spring support and piston in at least one position of the valve member, said valve means connected to said piston and controlling flow through said flowway in response to reciprocation of said piston, a control fluid conduit in said body extending from the side of the piston opposite said spring means, a stinger, means for releasably latching said stinger to said valve housing, a control fluid conduit in said stinger communicating with the control fluid conduit in said body when said stinger is latched to said valve housing, second valve means in said housing above said first valve means, means in said housing urging said second valve means toward closed position, and valve operator means carried by said stinger and operable to move said second valve means to open position and movable to an out of the way position to permit said second valve to be moved to closed position by said urging means.

15. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, first valve means positioned radially inward of said tubular connecting rod, said valve means connected to said connecting rod and controlling flow through said housing in response to reciprocation of said piston, said valve means having a valve member located between said spring support and piston in at least one position of the valve member, a control fluid conduit in said body extending from the side of the piston opposite said spring means, a stinger, means for releasably latching said stinger to said valve housing, a control fluid conduit in said stinger communicating with the control fluid conduit in said body when said stinger is latched to said valve housing, a pressure dome in said valve housing, a piston exposed to pressure in said dome urging the connecting rod toward valve closing position, a port in said housing, and means in said housing establishes fluid communication between said port and said control conduit.

16. A subsurface test tree adapted to be suspended in a blowout preventer stack comprising, a tubular valve housing, a cylinder in said housing, a spring support in said cylinder, a piston slidable in said cylinder, spring means extending between said spring support and said piston and urging said piston in one direction, a flow conduit providing a flowway extending axially through the housing and having a portion arranged radially inward from said spring means, first valve means including a valve member on the spring side of said piston and positioned at least in part in the portion of the flowway surrounded by said spring means and between said spring support and piston in at least one position of the valve member, said valve means connected to said piston and controlling flow through said flowway in response to reciprocation of said piston, a control fluid conduit in said body extending from the side of the piston opposite said spring means, a stinger, means for releasably latching said stinger to said valve housing, a control fluid conduit in said stinger communicating with the control fluid conduit in said body when said stinger is latched to said valve housing, a slick joint pierced to provide a flowway in the wall thereof depending from said housing, means in said housing establishes fluid communication between said flowway and said control fluid conduit, a coupling provides a fluted hanger depending from said slick joint, said coupling having a port and means establishing fluid communication between said port and the flowway in said slick joint, a tubing depending from said coupling, a hydraulically operated surface controllled subsurface safety valve in said tubing, and a conduit extends between said safety valve and the port in said coupling to provide pressure fluid to said safety valve.

17. A subsurface test tree adapted to be suspended in a blowout preventer stack comprising, a tubular valve housing, a cylinder in said housing, a spring support in said cylinder, a piston slidable in said cylinder, spring means extending between said spring support and said piston and urging said piston in one direction, a flow conduit providing a flowway extending axially through the housing and having a portion arranged radially inward from said spring means, first valve means including a valve member on the spring side of said piston and positioned at least in part in the portion of the flowway surrounded by said spring means and between said spring support and piston in at least one position of the valve member, said valve means connected to said piston and controlling flow through said flowway in response to reciprocation of said piston, a control fluid conduit in said body extending from the side of the piston opposite said spring means, a stinger, means for releasably latching said stinger to said valve housing, a control fluid conduit in said stinger communicating with the control fluid conduit in said body when said stinger is latched to said valve housing, annular seal rings carried on said stinger between the stinger and housing on opposite sides of the communication between the stinger control fluid conduit and the housing control fluid conduit, a C-ring carried in a square shouldered groove in the stinger between said seal rings, a slick joint pierced to provide a flowway in the wall thereof depending from said housing, means in said housing establishes fluid communication between said flowway and said control fluid conduit, a coupling provides a fluted hanger depending from said slick joint, said coupling having a port and means establishing fluid communication between said port and the flowway in said slick joint, a tubing depending from said coupling, a hydraulically operated surface controlled subsurface safety valve in said tubing, and a conduit extends between said safety valve and the port in said coupling to provide pressure fluid to said safety valve.

18. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, first valve means positioned radially inward of said tubular connecting rod, said valve means connected to said connecting rod and controlling flow through said housing in response to reciprocation of said piston, said valve means having a valve member located between said spring support and piston in at least one position of the valve member, a control fluid conduit in said body extending from the side of the piston opposite said spring means, a stinger, means for releasably latching said stinger to said valve housing, a control fluid conduit in said stinger communicating with the control fluid conduit in said body when said stinger is latched to said valve housing, a slick joint pierced to provide a flowway in the wall thereof depends from said housing, means in said housing establishes fluid communication between said flowway and said control fluid conduit, a coupling providing a fluted hanger depending from said slick joint, said coupling having a port and means establishing fluid communication between said port and the flowway in said slick joint, a tubing depending from said coupling, a hydraulically operated surface controlled subsurface safety valve in said tubing, and a conduit extends between said safety valve and the port in said coupling to provide pressure fluid to said safety valve.

19. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, first valve means positioned radially inward of said tubular connecting rod, said valve means connected to said connecting rod and controlling flow through said housing in response to reciprocation of said piston, said valve means having a valve member located between said spring support and piston in at least one position of the valve member, a control fluid conduit in said body extending from the side of the piston opposite said spring means, a stinger, means for releasably latching said stinger to said valve housing, a control fluid conduit in said stinger communicating with the control fluid conduit in said body when said stinger is latched to said valve housing, a pressure dome in said valve housing, a piston exposed to pressure in said dome urging the connecting rod toward valve closing position, a slick joint pierced to provide a flowway in the wall thereof depends from said housing, means in said housing establishes fluid communication between said flowway and said control fluid conduit, a coupling provides a fluted hanger depending from said slick joint, said coupling having a port and means establishing fluid communication between said port and the flowway in said slick joint, a tubing depending from said coupling, a hydraulically operated surface controlled subsurface safety valve in said tubing, and a conduit extending between said safety valve and the port in said coupling to provide pressure fluid to said safety valve.

20. A subsurface test tree adapted to be suspended in blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, a tubing depending from said housing, a hydraulically operated surface controlled subsurface safety valve in said tubing, a hydraulic line providing operating pressure fluid to said safety valve extending from said valve to a port in said housing, and means in said housing establishes fluid communication between said port and one of said control and balance fluid conduits.

21. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, a check valve preventing flow from said balance chamber when said stinger is removed from said valve housing, said check valve held unseated by said stinger when said stinger is latched to said valve housing, a tubing depending from said housing, a hydraulically operated surface controlled subsurface safety valve in said tubing, a hydraulic line providing operating pressure fluid to said safety valve extending from said valve to a port in said housing, and means in said housing establishes fluid communication between said port and one of said control and balance fluid conduits.

22. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, a pressure dome in said valve housing, a piston exposed to pressure in said dome urging the connecting rod toward valve closing position, a tubing depending from said housing, a hydraulically operated surface controlled subsurface safety valve in said tubing, a hydraulic line providing operating pressure fluid to said safety valve extending from said valve to a port in said housing, and means in said housing establishes fluid communication between said port and one of said control and balance fluid conduits.

23. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, second valve means in said housing above said first valve means, means in said housing urging said second valve means toward closed position, valve operator means carried by said stinger and operable to move said second valve means to open position and movable to an out of the way position to permit said second valve to be moved to closed position by said urging means, a tubing depending from said housing, a hydraulically operated surface controlled subsurface safety valve in said tubing, a hydraulic line providing operating pressure fluid to said safety valve extending from said valve to a port in said housing, and means in said housing establishes fluid communication between said port and one of said control and balance fluid conduits.

24. A subsurface test tree adapted to be suspended in a blowout preventer stack comprising, a tubular valve housing, a cylinder in said housing, a spring support in said cylinder,
a piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member,
said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
second valve means in said housing above said first valve means,
means in said housing urging said second valve means toward closed position,
valve operator means carried by said stinger and operable to move said second valve means to open position and movable to an out of the way position to permit said second valve to be moved to closed position by said urging means,
said valve operator means exposed to fluid in said control and balance fluid conduits in the stinger,
said first valve means provided by a ball valve,
a pressure dome is provided in said valve housing,
a piston exposed to pressure in said dome urges the connecting rod toward valve closing position, whereby the first valve will close and sever a line extending through the first valve prior to closing of the second valve,
a tubing depending from said housing,
a hydraulically operated surface controlled subsurface safety valve provided in said tubing,
a hydraulic line providing operating pressure fluid to said safety valve extending from said valve to a port in said housing, and
means in said housing establishes fluid communication between said port and one of said control and balance fluid conduits.

25. A subsurface test tree adapted to be suspended in a blowout preventer stack comprising,
a tubular valve housing,
a cylinder in said housing,
a spring support in said cylinder,
a piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member,
said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
a port in said housing, and
means in said housing establishing fluid communication between said port and one of said control and balance fluid conduits.

26. A subsurface test tree adapted to be suspended in a blowout preventer stack comprising,
a tubular valve housing,
a cylinder in said housing,
a spring support in said cylinder,
piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member,
said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
a check valve preventing flow from said balance chamber when said stinger is removed from said valve housing,
said check valve held unseated by said stinger when said stinger is latched to said valve housing,
a port in said housing, and means in said housing establishing fluid communication between said port and one of said control and balance fluid conduits.

27. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, a pressure dome in said valve housing, a piston exposed to pressure in said dome urging the connecting rod toward valve closing position, a port in said housing, and means in said housing establishing fluid communication between said port and one of said control and balance fluid conduits.

28. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, second valve means in said housing above said first valve means, means in said housing urging said second valve means toward closed position, valve operator means carried by said stinger and operable to move said second valve means to open position and movable to an out of the way position to permit said second valve to be moved to closed position by said urging means, a port in said housing, and means in said housing establishing fluid communication between said port and one of said control and balance fluid conduits.

29. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, second valve means in said housing above said first valve means, means in said housing urging said second valve means toward closed position, valve operator means carried by said stinger and operable to move said second valve means to open position and movable to an out of the way position to permit said second valve to be moved to closed position by said urging means, said valve operator means exposed to fluid in said control and balance fluid conduits in the stinger,
said first valve means provided by a ball valve,
a pressure dome in said valve housing,
a piston exposed to pressure in said dome urging the connecting rod toward valve closing position, whereby the first valve will close and sever a line extending through the first valve prior to closing of the second valve,
a port in said housing, and
means in said housing establishes fluid communication between said port and one of said control and balance fluid conduits.

30. A subsurface test tree adapted to be suspended in a blowout preventer stack comprising,
a tubular valve housing,
a cylinder in said housing,
a spring support in said cylinder,
a piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member,
said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
a slick joint pierced to provide a flowway in the wall thereof depending from said housing,
means in said housing establishing fluid communication between said flowway and one of said balance and control fluid conduits,
a coupling providing a fluted hanger depending from said slick joint,
said coupling having a port and means establishing fluid communication between said port and the flowway in said slick joint,
a tubing depends from said coupling,
a hydraulically operated surface control subsurface safety valve in said tubing, and
a conduit extends between said safety valve and the port in said coupling providing pressure fluid to said safety valve.

31. A subsurface test tree adapted to be suspended in a blowout preventer stack comprising,
a tubular valve housing,
a cylinder in said housing,
a spring support in said cylinder,
a piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member,
said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
all dynamic seals exposed to fluid flowing through the test tree also exposed to said balance chamber or said balance fluid conduits whereby a failure in a dynamic seal exposes the balance chamber to fluid flowing through the test tree,
a slick joint pierced to provide a flowway in the wall thereof depending from said housing,
means in said housing establishing fluid communication between said flowway and one of said balance and control fluid conduits,
a coupling providing a fluted hanger depending from said slick joint,
said coupling having a port and means establishing fluid communication between said port and the flowway in said slick joint,
a tubing depends from said coupling,
a hydraulically operated surface control subsurface safety valve in said tubing, and
a conduit extends between said safety valve and the port in said coupling providing pressure fluid to said safety valve.

32. A subsurface test tree adapted to be suspended in a blowout preventer stack comprising,
a tubular valve housing,
a cylinder in said housing,
a spring support in said cylinder,
a piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member, said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
a check valve preventing flow from said balance chamber when said stinger is removed from said valve housing,
said check valve held unseated by said stinger when said stinger is latched to said valve housing,
a slick joint pierced to provide a flowway in the wall thereof depending from said housing,
means in said housing establishing fluid communication between said flowway and one of said balance and control fluid conduits,
a coupling providing a fluted hanger depending from said slick joint,
said coupling having a port and means establishing fluid communication between said port and the flowway in said slick joint,
a tubing depends from said coupling,
a hydraulically operated surface control subsurface safety valve in said tubing, and
a conduit extends between said safety valve and the port in said coupling providing pressure fluid to said safety valve.

33. A subsurface test tree adapted to be suspended in a blowout preventer stack comprising,
a tubular valve housing,
a cylinder in said housing,
a spring support in said cylinder,
a piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member,
said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
a pressure dome in said valve housing,
a piston exposed to pressure in said dome urging the connecting rod toward valve closing position,
a slick joint pierced to provide a flowway in the wall thereof depending from said housing,
means in said housing establishing fluid communication between said flowway and one of said balance and control fluid conduits,
a coupling providing a fluted hanger depending from said slick joint,
said coupling having a port and means establishing fluid communication between said port and the flowway in said slick joint,
a tubing depends from said coupling,
a hydraulically operated surface control subsurface safety valve in said tubing, and
a conduit extends between said safety valve and the port in said coupling providing pressure fluid to said safety valve.

34. A subsurface test tree adapted to be suspended in a blowout preventer stack comprising,
a tubular valve housing,
a cylinder in said housing,
a spring support in said cylinder,
a piston slidable in said cylinder,
a tubular connecting rod extending from said piston toward said spring support and spaced radially inward from said cylinder to provide an annular space,
spring means in said annular space extending between said spring support and said piston,
seal means confining fluid in said annular space to provide a balance chamber,
first valve means having a valve member positioned radially inward of said tubular connecting rod between said spring stop and piston in at least one position of the valve member,
said first valve means connected to said connecting rod and controlling flow through said housing in response to reciprocation of said piston,
a control fluid conduit in said body extending from the side of the piston opposite said spring means,
a balance fluid conduit in said housing extending from said balance chamber,
a stinger,
means for releasably latching said stinger to said valve housing,
a control conduit in said stinger communicating with the control fluid conduit in said body when said stinger is latched to said valve housing,
a balance fluid conduit in said stinger communicating with said balance fluid conduit in said body when said stinger is latched to said valve housing,
annular seal rings carried between the stinger and housing on opposite sides of the communication between the control and balance conduits in the stinger with the control and balance conduits in the housing,
C-rings in square shouldered grooves in the stinger between said seal rings,
a slick joint pierced to provide a flowway in the wall thereof depending from said housing,
means in said housing establishing fluid communication between said flowway and one of said balance and control fluid conduits, a coupling providing a fluted hanger depending from said slick joint, said coupling having a port and means establishing fluid communication between said port and the flowway in said slick joint, a tubing depends from said coupling, a hydraulically operated surface control subsurface safety valve in said tubing, and a conduit extends between said safety valve and the port in said coupling providing pressure fluid to said safety valve.

35. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, second valve means in said housing above said first valve means, means in said housing urging said second valve means toward closed position, valve operator means carried by said stinger and operable to move said second valve means to open position and movable to an out of the way position to permit said second valve to be moved to closed position by said urging means, a slick joint pierced to provide a flowway in the wall thereof depending from said housing, means in said housing establishing fluid communication between said flowway and one of said balance and control fluid conduits, a coupling providing a fluted hanger depending from said slick joint, said coupling having a port and means establishing fluid communication between said port and the flowway in said slick joint, a tubing depends from said coupling, a hydraulically operated surface control subsurface safety valve in said tubing, and a conduit extends between said safety valve and the port in said coupling providing pressure fluid to said safety valve.

36. A subsurface test tree adapted to be suspended in a blowout preventer stack comprising, a tubular valve housing, a cylinder in said housing, a spring support in said cylinder, a piston slidable in said cylinder, a tubular connecting rod extending from said piston toward said spring support and spaced radially inward from said cylinder to provide an annular space, spring means in said annular space extending between said spring support and said piston, seal means confining fluid in said annular space to provide a balance chamber, first valve means having a valve member positioned radially inward of said tubular connecting rod between said spring stop and piston in at least one position of the valve member, said first valve means connected to said connecting rod and controlling flow through said housing in response to reciprocation of said piston, a control fluid conduit in said body extending from the side of the piston opposite said spring means, a balance fluid conduit in said housing extending from said balance chamber, a stinger, means for releasably latching said stinger to said valve housing, a control conduit in said stinger communicating with the control fluid conduit in said body when said stinger is latched to said valve housing, a balance fluid conduit in said stinger communicating with said balance fluid conduit in said body when said stinger is latched to said valve housing, second valve means in said housing above said first valve means, means in said housing urging said second valve means toward closed position, valve operator means carried by said stinger and operable to move said second valve means to open position and movable to an out of the way position to permit said second valve to be moved to closed position by said urging means, said valve operator means exposed to fluid in said control and balance fluid conduits in the stinger, said first valve means is provided by a ball valve, a pressure dome is provided in said valve housing, a piston exposed to pressure in said dome urges the connecting rod toward valve closing position, whereby the first valve will close and sever a line extending through the first valve prior to closing of the second valve, a slick joint pierced to provide a flowway in the wall thereof depending from said housing, means in said housing establishing fluid communication between said flowway and one of said balance and control fluid conduits, a coupling providing a fluted hanger depending from said slick joint, said coupling having a port and means establishing fluid communication between said port and the flowway in said slick joint, a tubing depends from said coupling, a hydraulically operated surface control subsurface safety valve in said tubing, and a conduit extends between said safety valve and the port in said coupling providing pressure fluid to said safety valve.

* * * * *